United States Patent [19]

Downs et al.

[11] 4,395,610

[45] Jul. 26, 1983

[54] PIVOTABLE MULTIPOLE SWITCH

[75] Inventors: Robert F. Downs, Santa Ana; Salvadore C. Santillan, Whittier, both of Calif.

[73] Assignee: Technology Management, Inc., Santa Ana, Calif.

[21] Appl. No.: 287,942

[22] Filed: Jul. 20, 1981

[51] Int. Cl.[3] ..... H01H 21/54

[52] U.S. Cl. ..... 200/292; 200/153 H; 200/162; 200/16 E; 200/1 A; 339/4; 339/75 M

[58] Field of Search ..... 200/292, 153 H, 162, 200/164 R, 164 A, 6 R, 6 C, 1 A, 16 E; 339/4, 74 R, 75 M, 75 MP

[56] References Cited

U.S. PATENT DOCUMENTS 2,226,386 12/1940 Ramsey ..... 200/16 Z
3,689,715 9/1972 Glenn ..... 200/16 R

FOREIGN PATENT DOCUMENTS 32582 12/1923 Denmark ..... 339/184 M
650115 2/1979 U.S.S.R. ..... 200/6 R

*Primary Examiner*—John W. Shepperd
*Assistant Examiner*—Renee S. Kidorf
*Attorney, Agent, or Firm*—William L. Chapin

[57] ABSTRACT

A switch for connecting a selected one of a plurality of multi-terminal connectors to a common connector comprises a pivotable printed circuit board having a planar array of parallel conductors on at least one side of the board extending to the edge of the board, and fixed female connectors having elastically deformable contacts selectably engageable with the planar edge contact arrays by pivoting the printed circuit board to the selected female connector position, the compressive spring force of the elastically deformable contacts upon the planar contacts holding the pivotable printed circuit board in engagement with the selected female connector.

20 Claims, 12 Drawing Figures

FIG. 1
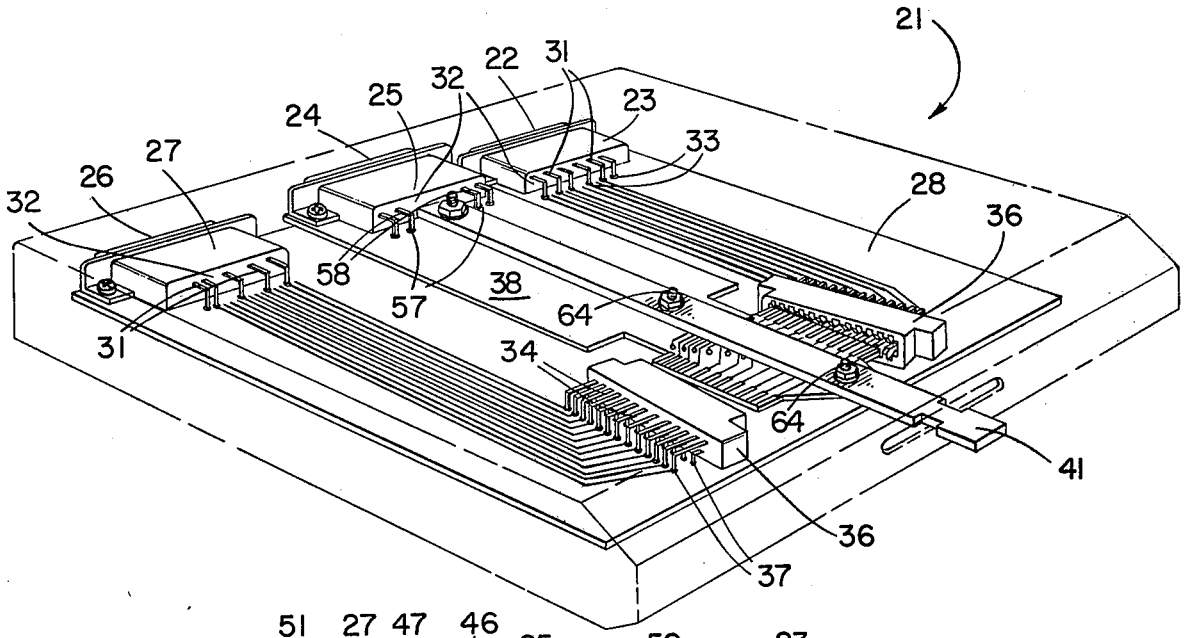
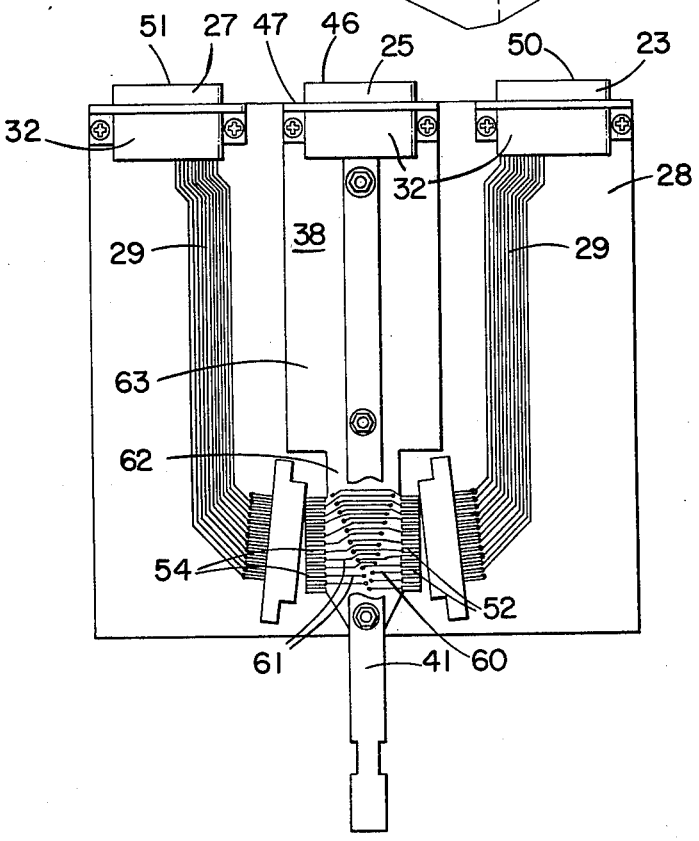
FIG. 2

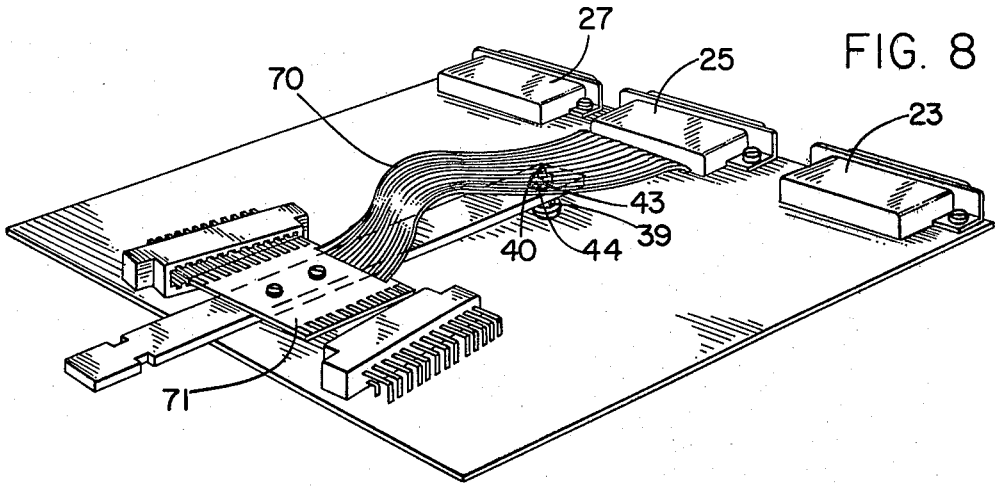
FIG. 8
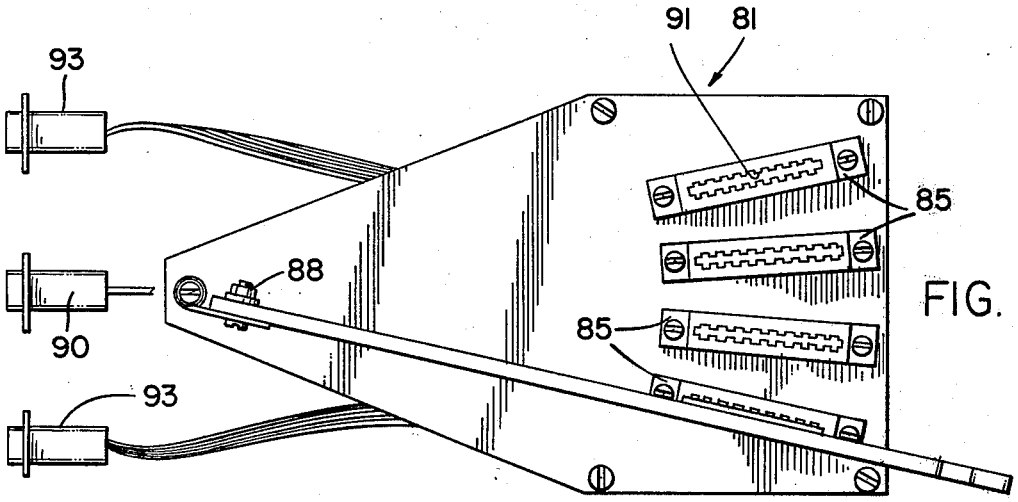
FIG. 9
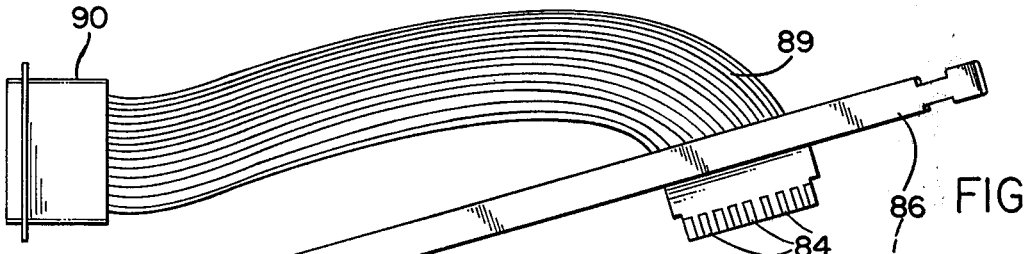
FIG. 10
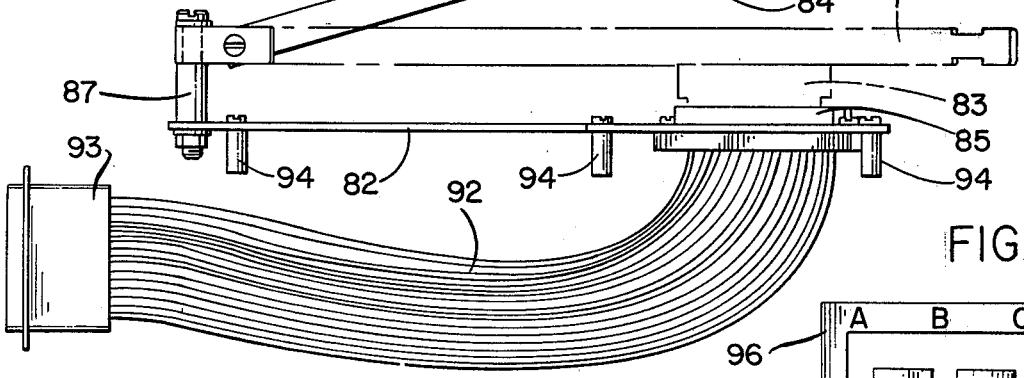
FIG. 11
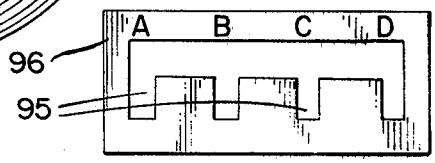

PIVOTABLE MULTIPOLE SWITCH

FIELD OF THE INVENTION

This invention relates to devices for electrically coupling one of a plurality of multiple conductor connectors to a third connector. In particular, the invention is useful for connecting a selected one of a plurality of data terminal devices to a common device, to permit time sharing the connection with the common device.

BACKGROUND OF THE INVENTION

The data processing and communication fields frequently require the use of multiple conductor cables to couple digital data and timing signals between subsystem components. Many such cables are terminated with multi conductor connectors to facilitate connecting and disconnecting various subsystem components.

For example, it is sometimes desirable to permit either of two computers to output data to a single printer. One way of accomplishing the selection of which computer will output data to the printer is to disconnect the cable coupling the non-selected computer to the printer, and reconnecting the cable from the selected computer to the printer. While this procedure is adequate for some purposes, it has certain disadvantages that make it somewhat inconvenient for some applications, and very inconvenient for others.

Because of the disadvantages of manually switching data cables, multi-conductor two-position switches are sometimes used to eliminate the requirement for physically connecting and disconnecting cables each time it is desired to change a cable coupling configuration. If the requirement is to couple either of two devices to another device by means of a switch, the switch is required to have at least two possible positions. Sometimes it is desirable to have a third or "off" switch position in which neither of the two input terminal ports of the switch are coupled to the output port. An off position is useful, for example, in permitting diagnostic testing or trouble shooting of the output device normally coupled to either of two input devices.

Although two-position switches for one and two conductors (referred to as SPDT or DPDT, for single-pole, double-throw and double-pole, double-throw respectively) are commonly available, switches capable of coupling greater numbers of conductors become increasingly expensive.

The problem of obtaining two or three position switches for data communication is aggravated by the fact that typical data processing interconnecting cables contain many conductors. For example the widely used Electronic Industries Association (EIA) RS-232-C Standard specifies use of 25-pin connectors. Presently available switches capable of connecting either of two 25-pin cables to a common output cable are both large and costly.

The present invention employs a pivotable printed circuit edge connector array design to permit construction of a low cost, two or three position multi-pole switch that is easily adaptable to interconnecting large numbers of conductors. An alternate embodiment affords more than two active switch positions. The invention also employs a diagonal contact wiping action to overcome two problems associated with the switching of low level analog or digital switches. The two problems are:

(1) The inability of low power signals to burn away oxidation or other contamination layers on switch contacts and (2) The development of high resistance interface points between low power switching contacts that have remained in one position for a long time.

OBJECTS OF THE INVENTION

An object of the invention disclosed herein is to provide means for coupling a selected one of a plurality of multi conductor cables to a common output cable. Another object of the invention is to provide means for conveniently coupling one of two electrical devices requiring multi conductor input/output connections to a common device, thereby facilitating the time-shared usage of the common device.

Another object of the invention is to afford means permitting rapid and easy manual electrical connection of a selected one of two electrical devices to a third electrical device. Another object of the invention is to provide a multi-pole switch that has a small thickness. Another object of the invention is to provide a switch having a large electrical bandwidth capability, thereby minimizing attenuation and distortion of high frequency signals. Another object of the invention is to provide a switch that eliminates the need for cams, springs, latches or other such means to maintain the movable member of the switch fixed at its selected position. Another object of the invention is to provide a switch that affords a positive visual indication of which of two input connectors electrically couples to a common output connector. Another object of the invention is to provide a switch design that is inherently modular, facilitating adaptation of the basic design to larger or smaller numbers of conductors. Another object of the invention is to provide a switch design that utilizes printed circuit technology to minimize both tooling and recurring costs. Another object of the invention is to provide a switch that displaces contact surface contamination layers and provides low resistance contacting for low level signals. Another object of the invention is to provide a switch that maintains low contacting resistance for low-level signals even when the switch remains in a fixed position for long periods of time.

Various other objects and advantages of the present invention will appear from the following descriptions of embodiments of the invention, and the most novel features will be particularly pointed out hereinafter in connection with the appended claims.

It is to be understood that although the invention disclosed herein is fully capable of achieving the objects and providing the advantages hereinbefore mentioned, the structural and operational characteristics of the invention described herein are merely illustrative of the preferred embodiments. Accordingly, we do not intend the scope of our exclusive rights and privileges in the invention to be limited to the details of construction and operation described, but only to those embodiments and their reasonable equivalents and adaptations delineated in the appended claims.

BRIEF SUMMARY OF THE INVENTION

Briefly stated, this invention comprehends a switch for connecting a common multi conductor electrical circuit to the selected one of a plurality of other circuits, or to disconnect the common circuit from all other circuits.

In one embodiment of the invention, the movable component of the switch comprises a substantially rectangular printed circuit board with a female multi conductor connector mounted on the upper side of the rear of the board. The female connector is centered on the long axis of the board, the open end of the connector extending slightly beyond the rear edge of the board. Near the front end of the board, an array of parallel rectangular printed circuit conductor traces on the upper side of the board extends transversely some distance from the center line of the board to the right hand edge of the board. A matching parallel array of parallel conductor traces is disposed in the same manner on the under side of the right front edge of the board.

Similar parallel arrays of upper and lower printed circuit conductor traces are disposed in a mirror-image position on the left hand front edge of the board.

Electrical connection between the right half of the rear female connector pins and the transverse printed circuit traces on the under side of the right front edge of the board is made by longitudinal traces on the right of the center line of the board extending forward from printed circuit pads soldered to pins extending downward from the rear connector and through the printed circuit board.

Electrical connection between the left half of the rear female connector pins and the transverse printed circuit traces on the under side of the left front edge of the board is made by longitudinal traces on the left side of the board in an exactly similar manner.

Electrical connection to the transverse printed circuit traces on the upper side of the right front edge of the board is made to directly opposite traces on the under side of the left front edge by smaller circuitous, substantially transverse traces running from the inner edges of the upper right side traces to plated-through holes positioned directly over respective longitudinal traces on the lower left front side of the board. Connection to upper left hand traces is made to lower right front side longitudinal traces in an exactly similar manner by smaller circuitous traces extending transversely to the right.

The rectangular printed circuit board just described is pivotably mounted above and parallel to a larger substantially square printed circuit board by a pivot positioned on the center line of both boards and near the rear edge of both boards.

Female multi conductor connectors similar to the one mounted on the rear of the pivotable board are mounted on the large board. The former two connectors are mounted in substantially parallel right and left hand positions to the one on the rear of the pivotable board, equidistant from the longitudinal axes defining the center lines of the two boards. With the pivotable board in its neutral or off position, the longitudinal axes of the two boards are parallel to themselves, and to the center lines of all three connectors.

On the upper side of the large printed circuit board near its front edge are mounted two connectors in mirror image positions and spacing to the right and left respectively of the longitudinal axis of the board. Each of these two identical connectors has rows of upper and lower bifurcated contact strips that are disposed inward from and perpendicular to the front mating surfaces of the connectors, and parallel to the upper surface of the board. While the axes of each connector is parallel to the upper surface of the board, the axes of both are canted outward slightly from the longitudinal axis of the board viewing the board from rear to front. Thus the distance between the front edges of the two connectors is slightly larger than the distance between the rear edges.

The rows of bifurcated contact strips in the front connectors are elastically deformable and adapted to the insertion by and interference engagement of the upper and lower transversely disposed parallel arrays of printed circuit edge traces contained on both front sides of the pivotable printed circuit board.

Electrical contact to the upper row of bifurcated contacts in each front connector is made by longitudinally disposed traces on the upper side of the large board extending from one half of the corresponding rear connector pins.

Each bottom row of bifurcated contacts is coupled to the remaining half of the corresponding rear connector by printed circuit traces on the under side of the large printed circuit board. Each trace is terminated by a pad and hole, and conductors extending backward and then downward at right angles from the bifurcated connectors penetrate the holes and are soldered to the pads.

The operating handle for the switch comprises an insulating bar mounted on top of the pivotable printed circuit board. The bar is centered over the longitudinal axis of the board and extends parallel to that axis some distance forward beyond the front edge of the board.

To electrically couple the center rear connector to the right rear connector, the handle is moved as far to the right as possible. This action causes the right front edge of the pivotable circuit board to move between the upper and lower rows of bifurcated contacts in the right front connector. The composite thickness of the printed circuit board cross section sandwiched between parallel upper and lower transverse conductor edge traces is slightly greater than the undeformed spacing between each upper and lower bifurcated connector contact. Each bifurcated contact comprises a split metal strip disposed inward from and perpendicular to the front surface of the connector. Each contact is elastically deformable along a vertical axis joining upper and lower contacts in a pair. Thus inserting the right front side edge of the pivotable printed circuit board into the right front bifurcated connector causes the edge of the board to wedge between upper and lower rows deformable contacts. This results in low resistance compressive contacting between each bifurcated contact and adjacent transverse printed circuit edge conductor trace. The frictional engagement between printed circuit board edge and deformed bifurcated contacts maintains the pivotable member of the switch in fixed relation to the front connector.

To uncouple the middle rear connector from right rear connector, a force sufficient to disengage the front right edge of the pivotable printed circuit board from the right front connector is applied to the switch handle. If it is then desired to couple the middle rear connector to the left rear connector the handle is moved to the left until the left front edge of the pivotable board forcibly engages the left front connector.

With the pivotable printed circuit board pivoted all the way to the left or right, the front side edge of the pivotable board is parallel to the front surface of its mating connector. That relationship requires that the longitudinal axis of each front connector be canted slightly outward from front to rear of the large printed circuit board, relative to the longitudinal axis of that board. Thus in the central, neutral position of the pivotable board, the centerlines of the printed circuit edge conductor traces, which are perpendicular to longitudinal axis of the pivotable board, are at a small angle to the centerlines of the corresponding bifurcated contacts which latter centerlines are perpendicular to the front surface of the bifurcated connector. Accordingly, moving the edge traces into engagement with corresponding fixed bifurcated contacts causes the latter to execute diagonal sweeping actions on the surface of each edge trace. The diagonal sweeping action is effective in abrading surface contaminants and oxide coatings which may form on either the printed circuit traces or bifurcated contacts.

BRIEF DESCRIPTION OF THE DRAWINGS

FIG. 1 is a top perspective view of the switch in the central neutral or off position.

FIG. 2 is a top plan view of the switch with edge connector portion of the switch in the central neutral position.

FIG. 8 is a top perspective view of an alternate embodiment of the invention.

FIG. 9 is a top perspective view of a multi-position embodiment of the invention having more than two active switching positions.

FIG. 10 is a side elevation view of the multi-position embodiment.

FIG. 11 is a front elevation view of the multi-position embodiment.

DESCRIPTION OF THE INVENTION

Figure 3:
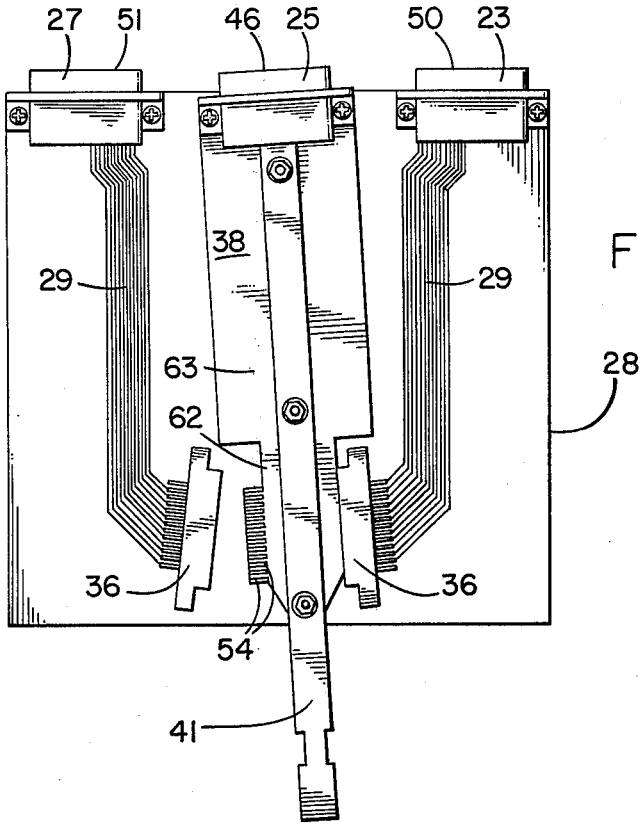
FIG. 3 is a top plan view of the switch with edge connector portion of the switch in the right hand position.
Figure 4:
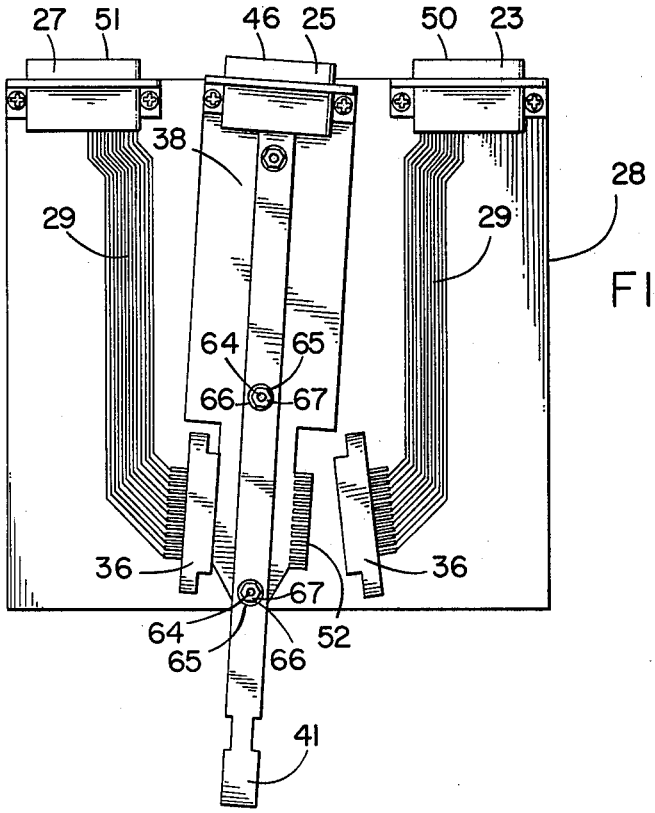
FIG. 4 is a top plan view of the switch with edge connector portion of the switch in the left hand position.
Figure 5:
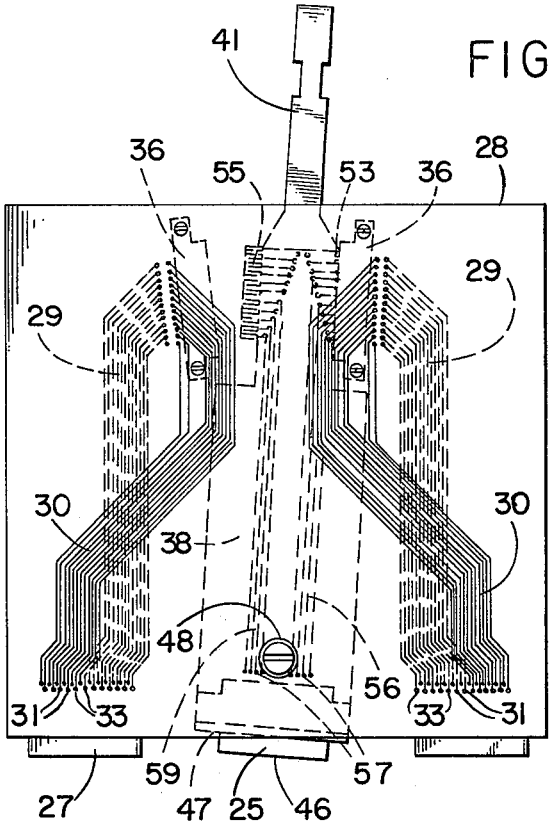
FIG. 5 is a bottom plan view of the switch in the right hand position.
Figure 6:
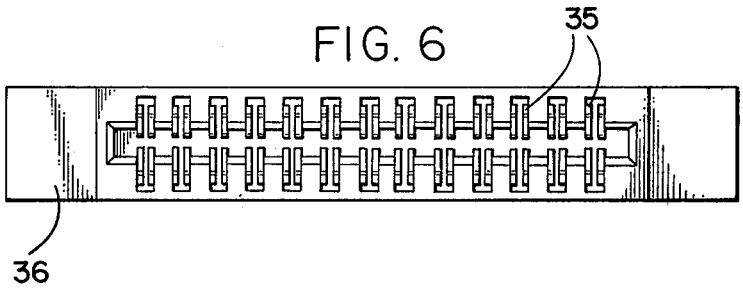
FIG. 6 is a front elevation view of a front bifurcated connector.
Figure 7:
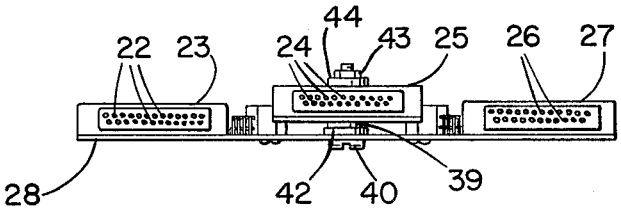
FIG. 7 is a rear elevation view of the switch in the central neutral position.
Figure 7A:
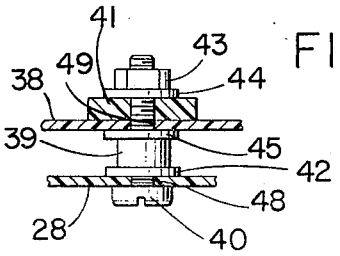
FIG. 7A is a magnified view of the pivot shown in FIG. 7.

Referring now primarily to FIG. 1 but also to FIGS. 2 through 7, a switch 21 is shown for selectably effecting electrical connection between contact pins 22 of right rear connector 23 and corresponding contact pins 24 of center rear connector 25, or between contact pins 26 of left rear connector 27 and corresponding contact pins 24 of center rear connector 25.

The base of switch 21 comprises a thin, uniform cross section, substantially square base panel 28 of electrically non conductive material suitable for affixing printed circuit conductive traces to, such as fibre glass filled expoxy, or phenolic.

Electrical connection is made between connector pins 22 and 26 and printed circuit traces 29 on the upper side of base panel 28 and traces 30 on the lower side of base panel 28 by means of extensions 31 of connector pins 22 and 26 which extend outward from the rear surfaces 32 of the connectors, and downward at right angles through printed circuit pads 33 and are soldered thereto.

On the upper side of base panel 28 near its front edge are mounted two identical connectors 36 in mirror image positions and spacing, to the right and left respectively of the longitudinal axis of the base panel. Connector 36 has rows of upper and lower bifurcated contact strips 35 that are disposed inward from and perpendicular to the front mating surfaces of the connectors.

Connector pin extensions 34 electrically coupled to bifurcated contacts 35 of bifurcated connectors 36 extend downward at right angles through printed circuit pads 37 and are soldered to the pads. Pads 37 nearest connectors 36 are electrically continuous with bottom-side traces 30, while outer pads 37 are coupled to top-side traces 29.

Approximately half of the rear connector pins 22 and 26 are coupled to the top row of bifurcated contacts by top-side printed circuit traces 29. The remainder of the rear connector pins are coupled to the lower row of bifurcated contacts by bottom-side traces 30.

The movable component of the switch comprises a substantially rectangular printed circuit board 38 composed of material similar to that used for the switch base panel 28.

Rectangular printed circuit board 38 is pivotably mounted above base panel 28 by means of bushing 39 and machine screw 40 which passes through holes through base panel 28, through printed circuit board 38, and through operating handle 41. Machine screw 40 is secured to base panel 28 by nut 42, and rectangular printed circuit board 38 is secured in a plane parallel to base board 28 by nut 43 and washers 44 and 45.

A multi conductor connector 25 similar to connectors 23 and 27 on base panel 28 is mounted on the upper surface of rectangular printed circuit board 38. The front mating surface 46 of connector 25 faces rearward and extends slightly beyond the rear edge 47 of board 38. Pivot screw 40 is mounted on the longitudinal center line of base panel 28. Pivot holes 48 and 49 lie on the longitudinal center lines of base panel 28 and rectangular printed circuit board 38, respectively. The spacing of the pivot axis from the rear edge of base panel 28 and rectangular printed circuit board 38 is such as to place the mating surfaces 50, 46 and 51 of of connectors 23, 25, and 27 respectively all in one plane when the longitudinal center lines of the base board and rectangular printed circuit board are parallel.

Near the front end of board 38, an array of rectangular printed circuit condutor traces 52 is fixed to the upper surface of the board. The traces extend transversely some distance from the longitudinal center line of the board to a position flush with the right edge of the board. A matching parallel array 53 of parallel conductor traces is fixed to the lower surface of right front edge of the board in the same manner.

Similar parallel arrays 54 and 55 of upper and lower printed circuit conductor traces are disposed in a mirror image position on the left front edge of the board. The width and spacing of each rectangular printed circuit conductor trace in each array is the same, and is chosen to match the width and spacing therebetween of bifurcated contacts 35 of connectors 36.

Electrical connection between the right half of rear connector pins 24 and transverse printed circuit traces 53 on the under side of the right front edge of board 38 is made by longitudinal traces 56 on the under side of the board and lying to the right of its center line. Traces 56 extend forward from printed circuit pads 57 soldered to pins 58 extending downward from rear connector 25 through printed circuit board 38.

Electrical connection between the left half of rear connector pins 24 and transverse printed circuit traces 55 on the under side of the left front edge of the board is made by longitudinal traces 59 on the under side of the board and lying to left of its center line. Traces 59 extend forward from printed circuit pads 57 soldered to pine 58 extending downward from rear connector 25 through printed circuit board 38.

Electrical connection to transverse printed circuit traces 52 on the upper side of the right front edge of board 38 is made to directly opposite traces 55 on the under side of the left front edge of the board by narrower, circuitous substantially transverse traces 60 running from the inner edges of the upper right side traces 52 to plated-through holes positioned directly over corresponding longitudinal traces 59 on the lower side of the left front portion of the board.

Electrical connection to transverse printed circuit traces 54 on the upper side of the left front edge of board 38 is made to directly opposite traces 53 on the under side of the right front edge of the board by narrower traces 61 running from the inner edges of the upper left side traces 54 to plated-through holes positioned directly over corresponding longitudinal traces 56 on the lower side of the right front portion of the board.

The width of the front portion 62 of board 38 is less than the width of the rear portion 63 of the board. The purpose of the width reduction is to reduce the angular excursion of board 38 in moving between connectors 36 from the excursion that would be required if the edge traces extended transversely further from the board center line.

The operating handle for the switch comprises an insulating bar 41 mounted on top of the printed circuit board by means of machine screws 64, washers 65, lock washers 66 and nuts 67, and also by machine screw 40, washers 44 and 45 and nut 43.

FIG. 8 shows an alternate embodiment of the two-position switch shown in FIGS. 1 through 7 and described above. In the alternate embodiment shown in FIG. 8, a flexible cable 70 connects center rear connector 25 to small printed circuit board 71. The flexibility of cable 70 permits printed circuit board 71 to be pivoted right or left to either of two switch engagement positions while rear connector 25 remains in a fixed position. Thus in this embodiment common rear connector 25 may be fixedly fastened in relation to rear connectors 23 and 27.

FIGS. 9 and 10 show a second alternate embodiment of the invention having more than two active switching positions. Referring now to FIGS. 9 and 10, a switch 81 is shown comprising a base panel 82, printed circuit board 83, edge trace connectors 84 bifurcated connectors 85, operating handle 86, vertical pivot bushing 87 and horizontal pivot bushing 88. Edge trace connectors 84 on printed circuit board 83 are electrically coupled by means of flexible cable 89 to corresponding connector pins on center rear connector 90. Bifurcated connector pins 91 on connectors 85 are electrically coupled by means of flexible cables 92 to corresponding connector pins on rear connectors 93. Clearance for flexible cables 92 is provided by elevating base panel 82 by means of stand-off bushings 94.

To operate the switch, handle 86 is lifted and pivoted upward around the axis of horizontal bushing 88. Thus the motion of the handle and printed circuit board 83 is in a vertical plane, shown in FIG. 10 in an exagerated fashion for clarity. Handle 86 is then moved horizontally around the axis of vertical bushing 87 until the handle is brought into vertical alignment with the desired one of detent slots 95 in front panel 96. The handle is then pivoted downward into the selected detent slot, forcibly engaging printed circuit board edge connector traces between bifurcated contacts 91. Thus by moving the switch handle sequentially upward, right or left and downward, the selected one of four rear connectors 93 may be electrically coupled to common center rear connector 90. While only four front connectors 85 and associated rear connectors 93 are shown in FIGS. 9 and 10, it is obvious that many more connectors and corresponding switch positions could be added to this embodiment of the invention. For example, by appropriately repositioning flexible cable 89, an upward facing mirror image of printed circuit board 83 could engage downward facing mirror images of connectors 85.

In each of the embodiments described herein, the planar male connector is described and pictured as being fixed to the pivotable member of the switch. While this is the preferred location for the parallel male connector, the novel advantages afforded by the switch described herein are also afforded by an alternate embodiment in which the planar male connector is fixedly mounted to the switch base panel, while the female connector is fixed to the pivotable member of the switch.

What we claim is:

1. An electrical switch for connecting and disconnecting a plurality of isolated electrical conductors comprising:

(a) an insulating base panel,
(b) a thin substantially flat insulating sheet,
(c) means for pivotably supporting said sheet on said base panel,
(d) a plurality of parallel planar conductors mounted substantially flush with at least one side of said sheet and extending to at least one edge of said sheet,
(e) at least one connector mounted on said base panel and having an array of parallel elastically deformable conductors forcibly engageable with the parallel planar conductors on said sheet,
(f) means for forcibly engaging and disengaging said sheet with said connector,
(g) means for making electrical connections to said parallel planar conductors, and
(h) means for making electrical connections to said elastically deformable conductors.

2. The device of claim 1 wherein the plurality of parallel planar conductors is further defined as comprising a selectively etched flat metal sheet bonded to a flat insulating sheet.

3. An electrical switch for connecting and disconnecting a plurality of isolated electrical conductors comprising:

(a) an insulating base panel,
(b) a thin substantially flat insulating sheet,
(c) means for pivotably supporting said sheet parallel to and above said base panel,
(d) a plurality of parallel planar conductors mounted substantially flush with at least one side of said sheet and extending to at least one edge of said sheet,
(e) at least one connector mounted on said base panel and having an array of parallel elastically deformable conductors forcibly engageable with the parallel planar conductors on said sheet,
(f) means for forcibly engaging and disengaging said sheet with said connectors, (g) means for making electrical connections to said parallel planar conductors, and
(h) means for making electrical connections to said elastically deformable conductors.

4. An electrical switch for connecting and disconnecting a plurality of isolated electrical conductors comprising:
(a) an insulating base panel,
(b) a thin substantially flat insulating sheet,
(c) means for pivotably supporting said sheet parallel to and above said base panel,
(d) a plurality of parallel planar conductors mounted substantially flush with at least one side of said sheet and extending transversely from the longitudinal center line of said sheet to at least one edge of said sheet,
(e) at least one connector mounted on said base panel and having an array of parallel elastically deformable conductors forcibly engageable with the parallel planar conductors on said sheet,
(f) means for forcibly engaging and disengaging said sheet with said connectors,
(g) means for making electrical connections to said parallel planar conductors, and
(h) means for making electrical connections to said elastically deformable conductors.

5. The device of claim 4 wherein each connector with elastically deformable conductors is further defined as being mounted such that the array of parallel elastically deformable conductors is parallel to the upper surface of the base panel, each conductor being perpendicularly disposed inward from the mating surface of the connector with said mating surface canted outward slightly from the longitudinal axis of the base panel, thereby making the spacing between the front portion of the mating surface and the center line of the base panel slightly greater than the spacing between the rear portion of the mating surface and the center line.

6. The device of claim 5 wherein the means for making electrical connections to the parallel planar conductors on the insulating sheet comprises a flexible multi-conductor cable, each conductor of which cable is connected to the inner end of a parallel planar conductor on one end, and on the other end of the cable, to a terminal of a multi-conductor connector mounted on the rear of the base panel and near its center.

7. The device of claim 5 wherein the means for making electrical connections to the parallel planar conductors on the insulating sheet comprises longitudinal printed circuit traces on at least one side of the insulating sheet extending from the inner ends of the parallel planar conductors to the terminals of a multi-conductor connector mounted on the rear of the insulating sheet.

8. The device of claim 7 wherein the means for making electrical connections to the elastically deformable conductors comprises printed circuit traces on at least one side of the base panel extending from the deformable conductor connector terminals back to the terminals of a multi-conductor connector mounted on the rear of the base panel.

9. The device of claim 8 wherein the means for forcibly engaging and disengaging the insulating sheet with a connector having elastically deformable conductors comprises a handle fastened to the insulating sheet and extending beyond the front edge of the sheet.

10. An electrical switch for connecting and disconnecting a plurality of isolated electrical conductors comprising:
(a) an insulating substantially flat base panel,
(b) a pair of rearward facing rear multi-conductor connectors mounted on either side of the longitudinal center line of the base panel near the rear edge of the base panel,
(c) a pair of front multi-conductor connectors having upper and lower rows of parallel, elastically deformable contact strips, said strips being disposed perpendicularly inward from the front mating surface of said connectors, said connectors being mounted in mirror image positions equidistant from the longitudinal center line of the base panel near the front edge of the base panel, the long axis of each connector being canted outward slightly from the longitudinal center line of the base panel, viewing the panel from front to rear,
(d) conductors electrically connecting corresponding terminals in both left and right hand front/rear connector pairs,
(e) a substantially rectangular insulating sheet pivotably mounted above and parallel to the base panel, said sheet having its longitudinal center line above and parallel to the center line of the base panel in the neutral position of the pivotable sheet,
(f) right and left upper and lower row pairs of parallel planar conductors mounted substantially flush with the upper and lower sides of said pivotable sheet and extending perpendicularly from the longitudinal center line of said sheet to the right and left front edges respectively of said sheet, said parallel planar conductors being pivotably engageable with either the right or left front elastically deformable-contact connector mounted on the base panel,
(g) a rearward facing rear multi-conductor connector mounted on the pivotable sheet symmetrically with respect to the center line of the pivotable sheet,
(h) conductors electrically connecting the inner edges of the parallel planar conductors to terminals on the center rear connector, and
(i) an insulating handle mounted to and extending beyond the front edge of the pivotable sheet, thereby providing the capability for pivoting the sheet to either left-hand, right-hand, or central neutral switch positions.

11. The device of claim 10 wherein the means for pivotably supporting the flat insulating sheet parallel to and above the base panel comprises a hollow bushing perpendicularly positioned between the top of base panel and the bottom of the flat insulating sheet, said bushing being maintained in fixed relationship to the base panel and flat insulating sheet by a machine screw passing upward through a hole through the base panel on its longitudinal center line and near the rear edge of the base panel, through the center of the bushing, through a hole through the insulating sheet on its longitudinal center line and near the rear edge of the insulating sheet, and a nut and washer tightened to the upper end of the screw.

12. An electrical switch for connecting and disconnecting a plurality of isolated electrical conductors comprising:
(a) an insulating base panel,
(b) a thin substantially flat insulating sheet,
(c) means for pivotably supporting said sheet in a vertical plane perpendicular to said base panel,
(d) means for pivoting said sheet in a horizontal plane,
(e) a plurality of parallel planar conductors mounted substantially flush with at least one side of said sheet and extending to at least one edge of said sheet, (f) at least one connector mounted on said based panel and having an array of parallel elastically deformable conductors forcibly engageable with the parallel planar conductors on said sheet, (g) means for forcibly engaging and disengaging said sheet with said connector, (h) means for making electrical connections to said parallel planar conductors, and (i) means for making electrical connections to said elastically deformable conductors.

13. An electrical switch for connecting and disconnecting a plurality of isolated electrical conductors comprising:

(a) an insulating base panel, (b) a thin substantially flat insulating sheet, (c) means for pivotably supporting said sheet in a vertical plane perpendicular to said base panel, (d) means for pivoting said sheet in a horizontal plane, (e) a plurality of parallel planar conductors mounted substantially flush with at least one side of said sheet and extending transversely from the longitudinal center line of said sheet to one edge of said sheet, (f) at least one connector fixedly mounted with respect to said base panel and having an array of parallel elastically deformable conductors forcibly engageable with the parallel planar conductors on said sheet, (g) means for forcibly engaging and disengaging said sheet with said connector, (h) means for making electrical connections to said parallel planar conductors, and (i) means for making electrical connections to said elastically deformable conductors.

14. The device of claim 12 or 13 wherein the means for pivoting the flat insulating sheet in a horizontal plane comprises a vertical hollow bushing mounted on the center line of the base panel near the rear edge of the base panel and secured to the base panel by a screw passing upward through a hole in the base panel, through the bushing and a nut and washer tightened to the upper end of the screw.

15. The device of claim 14 wherein the means for pivotably supporting the flat insulating sheet in a vertical plane perpendicular to the base panel comprises a flat rectangular bar fastened to one side of said sheet near the front end of said bar, a rectangular vertical metal tab fastened to the upper portion of the vertical hollow bushing, and a horizontal bushing passing through the holes in the tab and rear end of the bar.

16. The device of claim 15 wherein each connector with elastically deformable conductors is further defined as being mounted such that the array of parallel elastically deformable conductors is perpendicular to the upper surface of the base panel, each conductor being perpendicularly disposed downward from the mating surface of the connector.

17. The device of claim 16 wherein the means for forcibly engaging and disengaging the insulating sheet with a connector having elastically deformable conductors comprises an extension of the flat rectangular bar beyond the front edge of said sheet.

18. The device of claim 17 wherein the means for making electrical connections to the parallel planar conductors on the insulating sheet comprises a flexible multi-conductor cable connecting the parallel planar conductors to the terminals of a multi-conductor connector.

19. The device of claim 18 wherein the means for making electrical connections to the elastically deformable conductors in each front connector comprises flexible multi-conductor cables connecting deformable connector terminals to the terminals of a corresponding multi-conductor connector.

20. An electrical switch for connecting and disconnecting a plurality of isolated electrical conductors comprising:

(a) an insulating substantially flat base panel, (b) a plurality of rearward facing multi-conductor connectors mounted perpendicular to the base panel, (c) a plurality of front multi-conductor connectors having right and left rows of parallel, elastically deformable contact strips, said strips being disposed perpendicularly downward from the top mating surface of said connectors, said connectors being mounted near the front edge of the base panel on radial lines connecting the front edge of each connector with a central pivot point near the rear edge of the longitudinal center line of the base panel, (d) conductors electrically connecting corresponding terminals in front and rear connector pairs, (e) a substantially rectangular vertically oriented insulating sheet pivotably mounted to the base panel and pivotable both parallel to and perpendicular to the base panel, (f) right and left rows of parallel planar conductors mounted substantially flush with the right and left sides of said pivotable sheet and extending perpendicularly downward from the longitudinal center line of said sheet, said parallel planar conductors being pivotably engageable with the selected one of the plurality of front multi-conductor connectors, (g) a center rearward facing rear multi-conductor connector mounted perpendicular to the base panel, (h) conductors electrically connecting the inner edges of the parallel planar conductors to terminals on the center rear connector, and (i) an insulating handle mounted to and extending beyond the front edge of the pivotable sheet whereby the sheet may be pivoted vertically to disengage it from a front connector, pivoted horizontally to a different connector positioned, and pivoted vertically to engage said sheet with a selected connector.

* * * * *